United States Patent [19]

Riefler et al.

[11] Patent Number: 4,649,360

[45] Date of Patent: Mar. 10, 1987

[54] SOLENOID VALVE WITH CONTRACTIBLE ASSEMBLY RING

[75] Inventors: Roger G. Riefler, Shaker Heights; John E. Ellison, Mayfield Heights, both of Ohio

[73] Assignee: Parker Vannifin Corporation, Cleveland, Ohio

[21] Appl. No.: 834,715

[22] Filed: Feb. 28, 1986

[51] Int. Cl.[4] ..... H01F 7/08

[52] U.S. Cl. ..... 335/255; 335/278

[58] Field of Search ..... 335/251, 255, 260, 278; 251/129.15

[56] References Cited

U.S. PATENT DOCUMENTS 4,054,854 10/1977 Marsden ..... 335/255

4,109,221 8/1978 Pauli ..... 335/255

*Primary Examiner*—George Harris

*Attorney, Agent, or Firm*—Joseph B. Balazs

[57] ABSTRACT

A solenoid valve assembly includes a valve body and an outwardly extending core tube assembly comprising a core tube, a fixed pole piece and a slidable plunger for actuating a valve in the valve body. An electromagnetic coil assembly comprising a flux frame and cylindrical coil is slidably and removably supported on the core tube and is secured in place by a contractible ring with a shoulder engaged in a groove in the outer end of the core tube. The ring is an injection molded plastic part and is split, having a tongue and socket interconnection with plural ratchet teeth thereon to provide adjustable constriction of the ring. A pair of integral spring fingers are provided on opposite sides of the ring to axially bias the coil assembly against the valve body.

17 Claims, 9 Drawing Figures

SOLENOID VALVE WITH CONTRACTIBLE ASSEMBLY RING

BACKGROUND OF THE INVENTION

This invention relates to solenoid valve assemblies and more particularly to a clamp ring for releasably securing the electromagnetic coil assembly on the core tube of a solenoid valve.

Solenoid valve assemblies conventionally comprise a valve body having a fluid valve therein and an electromagnetic device for actuating the valve in response to an electric current. The electromagnetic device typically comprises a core tube assembly, including a fixed pole piece and a slidable plunger retained in a core tube, and an electromagnetic coil assembly surrounding the core tube to create magnetic flux and movement of the plunger. It is desirable to be able to mount different coil assemblies on the core tube both for replacement purposes and for selection purposes due to different power requirements for certain valves and applications and because of the different power sources in existence. It is also desirable, on a production line basis, to be able to rapidly and accurately assemble or interchange coil assemblies on various valve structures, both of which may be slightly different in size due to manufacturing tolerances and the like.

It has become common to construct the electromagnetic coil assembly as a unit which can be removed for entire replacement or for replacement of component parts thereof and to facilitate high production assembly thereof. Typically, a clip or similar clamping device is employed which engages a groove formed in an outer part of a core tube or the fixed pole piece to secure the coil assembly on the core tube. A spring clip may be used to retain the clip in position and also to create a bias urging the coil assembly against the valve body. This form of assembly provides a device for resiliently mounting the coil assembly and for accommodating the stack up of tolerances of the various component parts.

One such prior art example of spring clip for a solenoid valve is described in U.S. Pat. No. 3,295,079 wherein a dome shaped clip having a central u-shaped yoke is retained in a groove at the outer end of a fixed pole piece, with the periphery of the clip in engagement with the upper surface of the solenoid coil assembly. No circumferential adjustment of the spring clip is possible with this device.

Another prior art example is disclosed in U.S. Pat. No. 3,281,740 wherein a plastic cap is snapped over an integral split collar to secure the latter in a groove of the core tube. This type of clamp relies on the resilient nature of the plastic material to yieldably accommodate dimensional variations of the core tube and housing, but is limited in this regard and typically requires separate spring washers and the like to achieve this function. Further, this type of device is essentially a two-part device joined by a connector strap and is subject to breakage due to the severe bending requirement. Further, it can only be applied at the end of a shaft and requires a difficult to mold undercut in its cap configuration.

A similar prior art example is shown in U.S. Pat. No. 3,727,160 wherein a spring clip is adapted to be slipped over the end of the core tube and retained by an overlying spring arm. The clip is shown in horseshoe and closed end configurations, but provides no circumferential adjustment feature.

Other prior art devices are disclosed in U.S. Pat. Nos. 3,818,398 and 4,055,823, both of which utilize a threaded securing member fastened over the end of a shaft. The former is simply a threaded nut while the latter is a two part device telescopically threaded to interengage with the housing of a coil assembly and a groove in the core tube.

Many versions of plastic clamp having interengaging teeth are known in the prior art. One such variation is described in U.S. Pat. No. 3,925,851. However, these are designed primarily for encirclement and clamping of an object such as a hose and none is known which is particularly suited for electromagnetic coil assembly applications in which an axial bias force is also desired.

SUMMARY OF THE INVENTION

The apparatus of the instant invention comprises a plastic clamp ring which is particularly suited for application in a solenoid valve assembly for retaining the electromagnetic coil assembly on the armature core tube portion of the valve structure. The valve structure comprises a valve body with a core tube extending outwardly therefrom, the latter terminating in a free end which includes an annular groove therein. The core tube contains a moveable plunger for actuating the valve in the valve body and a stationary pole piece secured at the annular groove. An electromagnetic coil assembly consisting of a flux frame housing and an electromagnetic coil is slidably disposed on the core tube and retained by the clamp ring at the location of the groove in the core tube.

The clamp ring is an injection molded unitary plastic part which is split at one location to have two free ends. The ring includes a thin flexible section opposite the free ends so that the latter may be separated sufficiently to laterally pass over the cylindrical surface of the core tube and then be drawn together to constrict the ring to a smaller diameter at the location of the groove in the core tube. The ring has a tongue and socket interconnect arrangement at the free ends, both the tongue and socket having a plurality of circumferentially spaced and interengageable teeth to provide an adjustable diameter interconnect mechanism. The teeth are sloped in opposite directions to facilitate relative sliding movement as the tongue enters the socket, but which interengage and latch to prevent withdrawal of the tongue. A release device is provided to allow manual separation of the teeth to allow removal and reuse of the ring for maintenance or interchange purposes. The ring further includes a pair of integrally molded spring fingers on opposite sides of the ring which extend beyond the lower transverse surface of the ring for resilient engagement with the adjacent coil assembly structure to resiliently secure the latter against the valve housing.

DETAILED DESCRIPTION OF THE INVENTION

Figure 1:
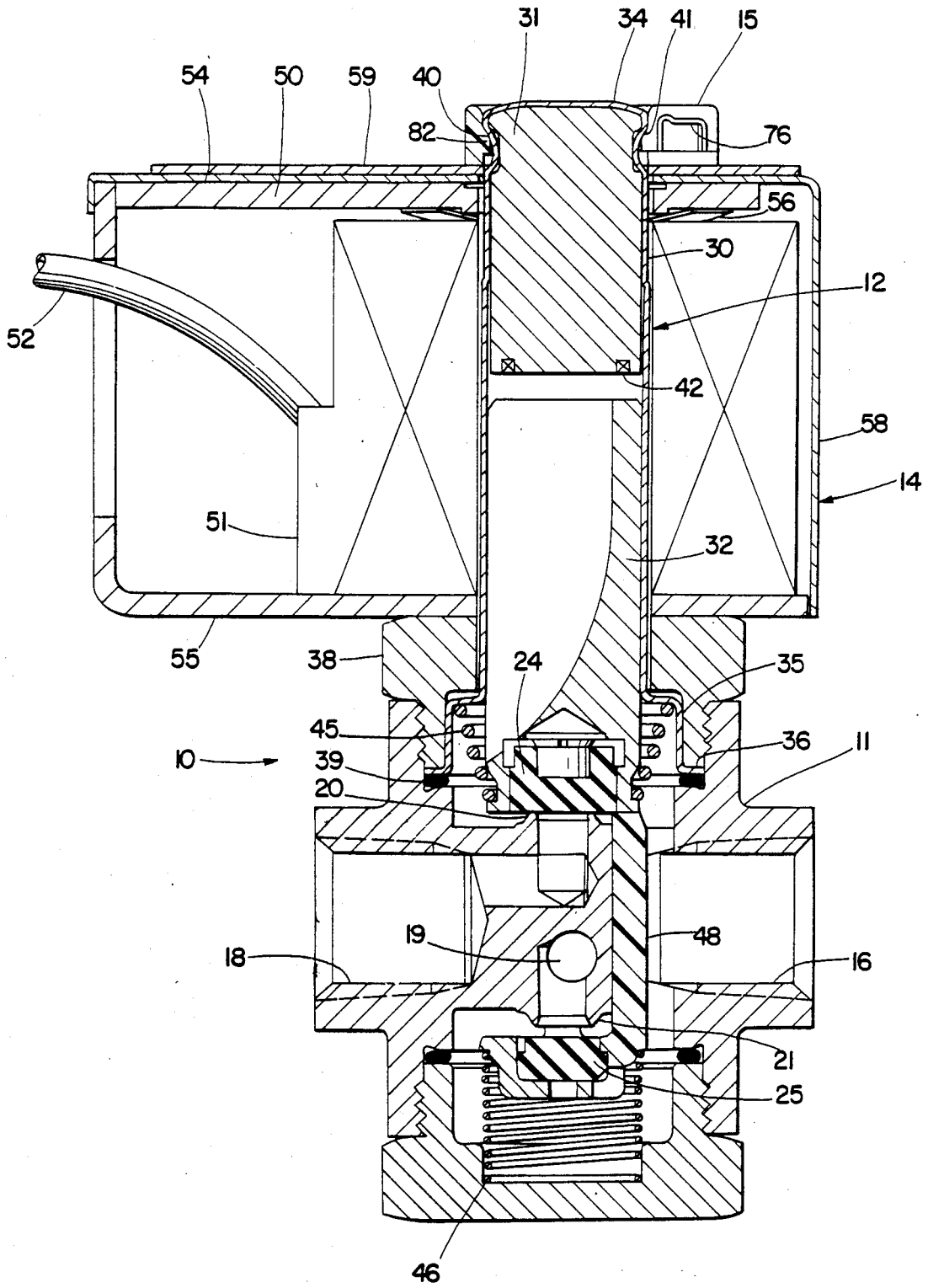
FIG. 1 is a sectional view of the solenoid valve assembly of the invention showing the clamp ring in engaged position at the upper portion thereof.
Figure 3:
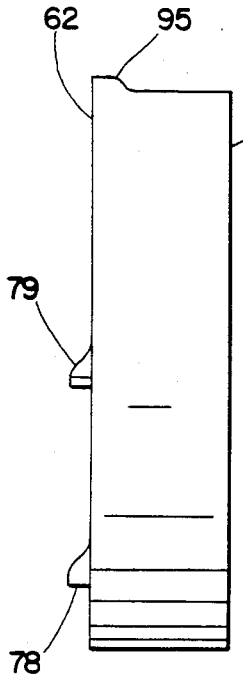
FIG. 3 is an end view of the clamp ring of FIG. 2.

Referring now to the drawings, there is shown in FIG. 1 a view in section of the solenoid valve assembly 10 of the invention, consisting essentially of valve body 11, core tube assembly 12, electromagnetic coil assembly 14 and contractible clamp ring 15. Valve body 11 is one example of fluid valve suitable for use within the teachings of this invention and comprises inlet port 16, outlet ports, 18, 19, respective valve seats 20, 21 and interconnecting passageways.

Valve seat 20 is closed by valve member 24 and valve seat 21 is closed by valve member 25 in an alternate manner as depicted in FIG. 1 to provide alternate fluid communication between inlet port 16 and outlet ports 18, 19 as is well understood in the art.

Fitted into an opening in the upper portion of valve body 11 is core tube assembly 12 which provides actuation of valves 24, 25 in response to applied magnetic flux acting against valve return spring forces. Core tube assembly 12 comprises core tube 30, fixed pole piece 31 and slidable plunger 32. In this embodiment of the invention core tube 30 is a sealed enclosure of tubular configuration, extending outwardly of valve body 11 to a free end 34. Core tube 30 has bell mouth 35 and flange 36 at its inner end and is retained in an opening in valve body 11 by threaded bonnet 38 which forces flange 36 against o-ring seal 39.

Core tube 30 includes annular groove 40 at free end 34 which serves in part to retain cylindrical pole piece 31 which includes a corresponding groove therein. Groove 40 is formed by rolling or the like of the periphery of core tube 30, and thus, will include an upper shoulder 41 forming a ledge to axially retain clamp ring 15, which will be described in greater detail hereinafter. The lower face of pole piece 31 includes shading ring 42 as is well understood in the art.

Core tube assembly 12 is completed by slidable, cylindrical plunger 32 which carries elastomeric valve member 24 in an aperture in the lower face thereof to cooperate with valve seat 20. Plunger 32 is biased downwardly by valve spring 45 to a normal lower position with valve element 24 in engagement with valve seat 20 establishing a space between plunger 32 and pole piece 31. In a similar manner lower valve 25 is moved away from lower valve seat 21 against the bias of lower return spring 46, being pushed by valve holder 48 whose legs remain in contact with the lower face of plunger 32. Valve spring 45 is stronger than return spring 46 to retain the valve elements in the positions depicted in FIG. 1, in the absence of a magnetic flux. Upon creation of such magnetic flux, plunger 32 will be moved upwardly to close the space between it and pole piece 31, opening valve seat 20 and allowing the closing of valve seat 21.

The electromagnetic valve assembly 14 for creating magnetic flux comprises flux frame 50 and electromagnetic coil 51, the latter in a conventional, generally cylindrical configuration having a central aperture adapted for close sliding engagement over core tube 30. Coil 51 is energized by electrical current applied through lead wires 52 to develop magnet flux in core tube assembly 12. Flux frame 50 also is conventional comprising a fabricated boxlike, rigid housing of magnetically permeable material having substantially planar and parallel upper and lower affixed plates 54, 55 respectively with apertures in each, adapted for slidable placement as a unit over and in close proximity to core tube 30. Flux frame 50 thus forms an enclosure for coil 51 and a return path for magnetic flux when coil 51 is energized. A wave washer 56 is typically positioned between coil 51 and the upper plate of flux frame 50 to retain the two as a unit when removed from the entire assembly 10, and to resiliently urge coil 51 in a downward direction. Sheet metal cover 58 and name plate 59, both having an aperture therein through which core tube 30 protrudes are disposed over one another to complete the enclosure of coil 51 and to serve as a firm support surface for clamp ring 15.

Figure 4:
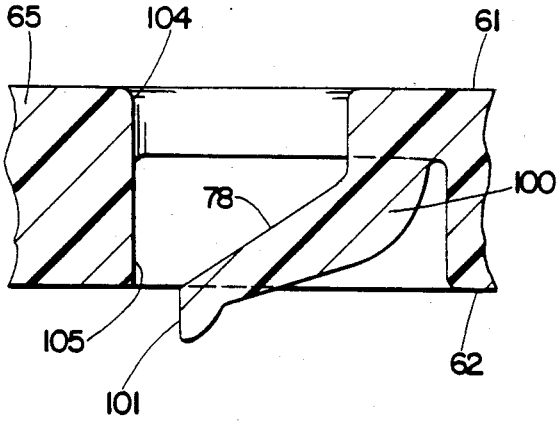
FIG. 4 is a sectional view of a portion of the clamp ring of FIG. 2 taken along the lines 4—4.
Figure 5:
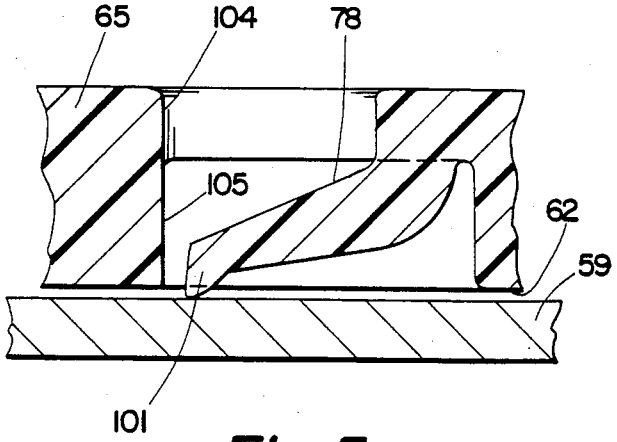
FIG. 5 is a sectional view of that portion of the clamp ring shown in FIG. 4, with the clamp ring in assembled relation in contact with adjacent structure.
Figure 6:
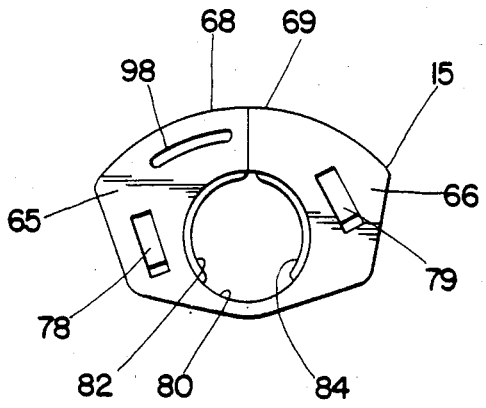
FIG. 6 is a plan view of the clamp ring similar to that of FIG. 2, but with the clamp ring in a closed condition.

Clamp ring 15 is best seen in FIGS. 2–9 as comprising an injection molded unitary plastic part which combines the functions of releasably securing coil assembly 14 in position and biasing same toward threaded bonnet 38 of valve body 11 in a manner which will accommodate circumferential and axial dimensional variations of the core tube 12 and coil 14 assemblies. Clamp ring 15 comprises a split, generally ring-shaped, contractible body member 60 having substantially parallel, flat upper and lower surfaces 61, 62 respectively, and is in the shape of a pair of clamp arms 65, 66 with adjacent free ends 68, 69 at the split location. Clamp arms 65, 66 are joined by a thin flexible section 70 so that the arms may be pivoted relative to one another to bring the free ends 68, 69 into closer or further adjacency or to an abutting position as is depicted in FIG. 6, where clamp ring 15 is shown in the fully closed condition.

Clamp ring 15 is preferably injection molded of polysulfone thermoplastic material which is a hard rigid polymer having very stable characteristics, but could be formed of other materials as well and by other manufacturing techniques. In one size of the invention the thickness of clamp ring 15 between surfaces 61, 62 is one the order of 0.20 inch with an overall width in the closed condition of about 1.0 inch. The width of flexible section 70 is one the order of 0.05 inch and this provides sufficient flexibility so that the clamp arms 65, 66 may be opened sufficiently to clear the diameter of core tube 30 as well as being closed to a condition in which the free ends 68, 69 are in abutment. Clamp ring 15 is molded in the condition depicted in FIG. 2 so that if clamp arms 65, 66 are moved to any other position, there will be a restoring force tending to return the arms 65, 66 to the position shown. This force is provided by the flexure of flexible section 70 and, as will be described, is utilized in retaining the clamp ring 15 in its clamped condition.

Figure 9:
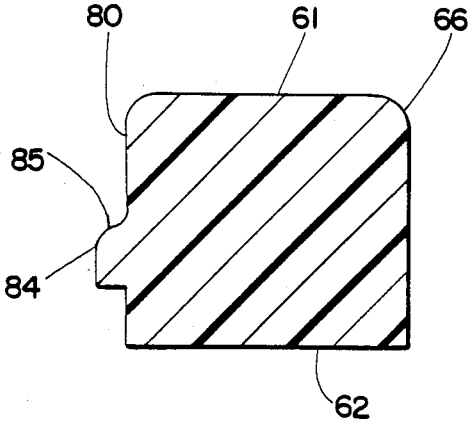
FIG. 9 is a sectional view of a portion of the clamp ring of FIG. 2, taken along the lines 9—9.

Clamp ring 15 further comprises an adjustable securing means consisting of a tongue 75 and socket 76 interconnecting device at free ends 68, 69 and an axial bias means consisting of a pair of spring fingers 78, 79 in the center portion of the clamp arms 65, 66. Clamp ring 15 further comprises central opening 80 which in the closed condition depicted in FIG. 6 is substantially circular and of a size substantially the same as the o.d. of core tube 30. A pair of arcuate ledges 82, 84, of lesser thickness than clamp ring 15, extend inwardly of opening 80 for a substantial part of the circumference of opening 80 and are radially sized to be snugly received in groove 40 of core tube 30. As best seen in FIGS. 1 and 9, ledges 82, 84 are curved at their upper surfaces 85 to conform to the curved shoulder 41 of groove 40, however this is not a necessity and a more squared configuration would serve as well. In this embodiment of the invention central opening 80, in the closed condition, would be on the order of 0.50 inch.

Figure 2:
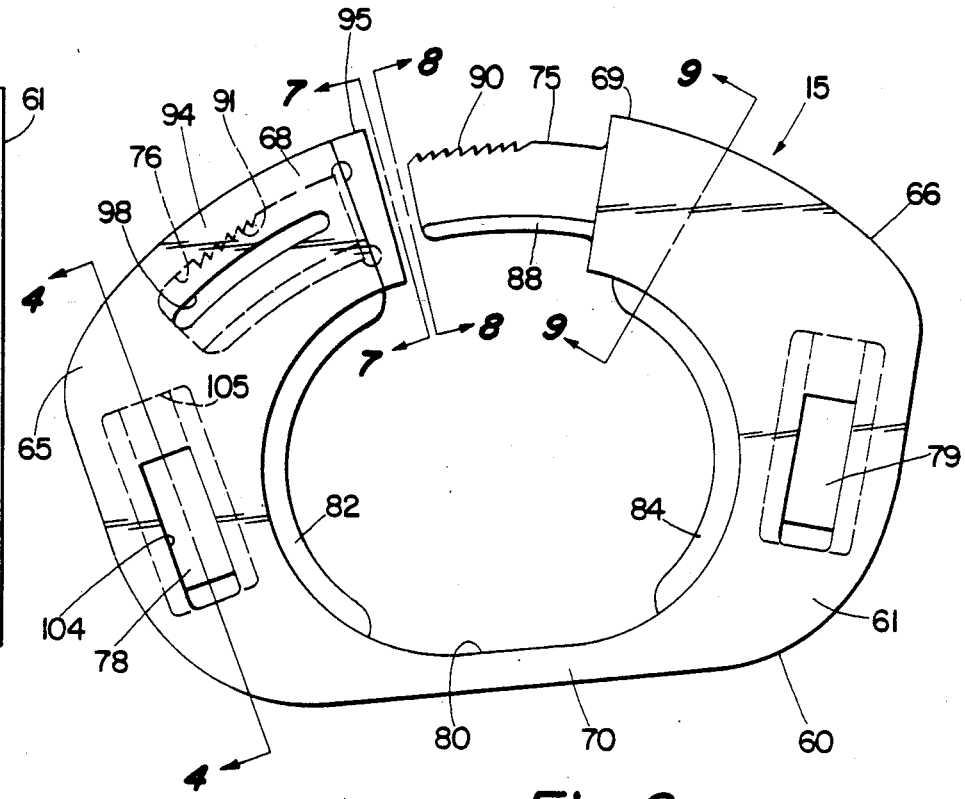
FIG. 2 is a plan view of the clamp ring of the invention removed from the solenoid valve assembly of FIG. 1 and in an open condition.
Figure 7:
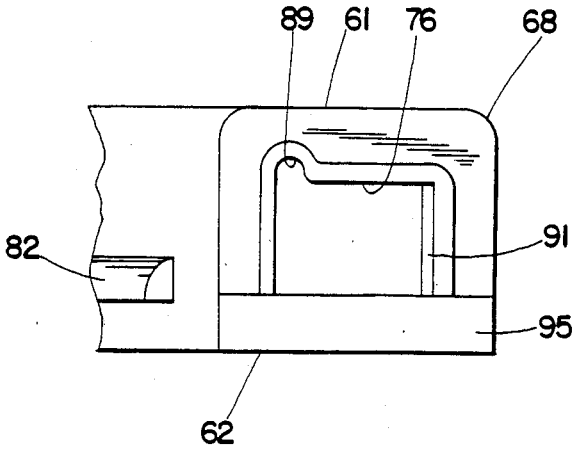
FIG. 7 is an end view of a portion of the clamp ring of FIG. 2, taken along the lines 7—7, and showing the interconnecting socket.
Figure 8:
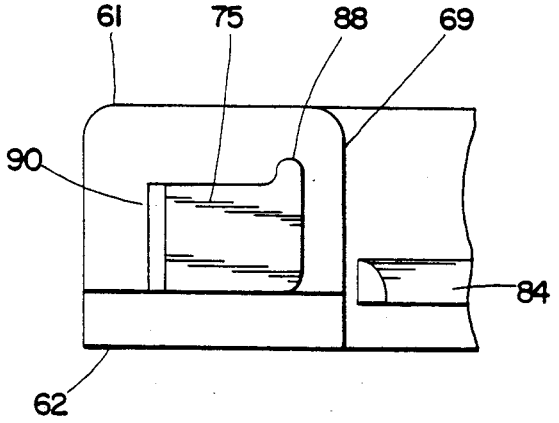
FIG. 8 is an end view of a portion of the clamp ring of FIG. 2, taken along the lines 8—8 and showing the interconnecting tongue.

The adjustable securing means for clamp ring 15 is best seen in FIGS. 2, 7 and 8 and comprises the slightly curved tongue 75 projecting from the end face of free end 69 toward and slightly spaced from free end 68. As seen in FIG. 8, tongue 75 is generally of rectangular cross sectional configuration and includes a small upstanding, similarly curved ridge 88 at its inner margin. Tongue 75 is formed generally on a curve having its center of curvature at the center of flexible section 70. The securing means further comprises a corresponding curved socket 76 in free end 68 of clamp arm 65, also of rectangular cross sectional configuration and having an upper groove 89 at the inner margin, so that socket 76 and groove 89 slidably receive tongue 75 and ridge 88 as clamp arms 65, 66 are closed. Both tongue 75 and socket 76 include a plurality of axially extending, circumferentially spaced teeth 90, 91 respectively, at their outer margins which are adapted to interengage and latch when tongue 75 is inserted in socket 76, to prevent withdrawal of tongue 75. Teeth 90, 91 extend parallel to one another the full thickness of tongue 75 and socket 76, respectively, and are sloped to allow the teeth 90, 91 to slide over one another as tongue 75 is inserted in socket 76, but to intermesh with the substantially radial surfaces of teeth 90, 91 in engagement, preventing withdrawal of tongue 75. As previously noted, tongue 75 is urged outwardly of socket 76 by the bias of flexible section 70 so that teeth 90, 91 are retained in firm interengagement. As best seen in FIG. 2, teeth 90 on tongue 75 have radial faces and are sloped toward free end 69, while teeth 91 in socket 76 also have radial faces, but are sloped in the opposite direction toward the inner end of socket 76. Teeth 90, 91 are evenly distributed circumferentially of tongue 75 and socket 76, and it will be apparent that tongue 75 may be inserted to any one of many discrete positions with various numbers of teeth 90, 91 in interengagement. This provides a device for adjustment of the spacing of clamp arms 65, 66, and thus, the size of central opening 80 to accommodate tolerance variations in the diameter of core tube 30 and the depth of retaining groove 40.

Tongue 75 and socket 76 are closely sized for a snug fit throughout their extent so that when tongue 75 is inserted teeth 90, 91 will be in substantially full intermeshing engagement and will be so retained to resist pull out of tongue 75. Upon insertion of tongue 75, the sloping faces of teeth 90, 91 will interengage and tend to outwardly cam the outer wall 94 of free end 68 which has teeth 91 formed therein until teeth 90 are able to slide thereover to a closed condition. Outer wall 94 is otherwise securely fixed to the inner portion of free end 68 by lower ledge 95 which spans the opening of socket 76 and which is received in a corresponding recess (not shown) beneath tongue 75 in free end 69, when clamp ring 15 is in the closed condition. Such structure is particularly suited for injection molding techniques whereby molds may be relatively axially moved and undercut configurations are avoided.

Flexure of outer wall 94 also provides a device for disengagement of teeth 90, 91 upon desired separation of clamp arms 65, 66 and removal of clamp ring 15. Slot 98 is provided for this purpose which slot extends through upper surface 61 of free end 68 in a curve generally matching the curvature of socket 76, for a circumferential extent slightly less than that of socket 76. Slot 98 is central of socket 76 and adjacent teeth 91 and is adapted so that when the blade of a screwdriver or other appropriate flat tool is inserted and twisted outer wall 94 will be urged outwardly relative to the remainder of free end 68 until disengagement of teeth 90, 91 occurs. At this time, tongue 75 will be released and clamp arms 65, 66 separated, under the urging of flexible section 70 or by manually applied force. Outer wall 94 is sufficiently thin and the material of clamp ring 15 sufficiently flexible to accommodate this flexure without permanent distortion, and outer wall 94 will be returned to its original position upon removal of the disengagement tool so that clamp ring 15 may be reused. During such disengagement, tongue 75 is prevented from following such outward distortion of outer wall 94 by the engagement of ridge 88 in groove 90, which assures disengagement of teeth 90, 91.

Spring fingers 78, 79 are best seen in FIGS. 2, 4 and 5. The description will be limited primarily only to spring 78, although a similar function is obtained in spring 79. The spring fingers 78, 79 are disposed centrally in respective clamp arms 65, 66 and are adapted to protrude from the bottom surface 62 of clamp ring 15 for engagement with name plate 59 or some other similar part of the structure of coil assembly 14. Spring 78 comprises an integrally molded finger of extended length having a base portion 100 emanating from upper surface 61 of clamp ring 15 and a tip 101 at the free end thereof which projects below lower surface 62. Spring finger 78 is in the form of a tapered and curved lever and is subject to flexure substantially evenly throughout its length in response to an axially applied bending moment. Spring finger 78 is integrally molded with clamp ring 15, being formed in the intersection of generally rectangular slot 104 in upper surface 61 and slightly larger corresponding slot 105 in lower surface 62. Spring finger 78 is of generally rectangular cross section tapering from a thicker base portion 100 to a thinner tip 101 and with a constant width of about 0.08 inch which is also the width dimension of upper slot 104. The length of spring finger 78 from base portion 100 to tip 101 is on the order of 0.30 inch and tip 101 is designed to project about 0.05 inch below lower surface 62. As can be visualized in FIG. 2 and 4, spring fingers 78, 79 can be formed integrally with clamp ring 15 by injection molding techniques in the preferred embodiment of this invention.

In the assembled condition as depicted in FIG. 5, the tip 101 of spring finger 78 is in engagement with adjacent structure of coil assembly 14, in this instance being name plate 59 lying on cover 54 and flux frame 50. Spring finger 78 is deformed throughout its length to a condition wherein tip 101 is partially recessed in lower slot 105, thereby exerting a bias in attempting to return to its relaxed position depicted in FIG. 4. This bias urges clamp ring 15 upwardly against shoulder 41 of groove 40 in core tube 30 through the engagement of ledges 82, 84 and urges the adjacent structure 59 constituting a part of electromagnetic coil assembly 14, downwardly against valve body 11. Spring finger 78 can be deformed to such an extent that tip 101 is entirely recessed in slot 105, above surface 62, exerting even greater bias, and also accommodating greater dimensional variations of core tube 30, the housing of coil assembly 14, fluid valve 11, and the like.

In this embodiment of the invention, tip 101 of spring finger 78 is designed to protrude nominally 0.02 inch below surface 62 of clamp ring 15 when in the assembled condition in engagement with plate 59 as shown in FIG. 5. This then provides accommodation for 0.02 inch variation in the upward direction before contact between plate 59 and surface 62 occurs. In the other direction, plate 59 may be spaced 0.04 inch from surface 62, which is a similar deviation of 0.02 inch for tip 101 from its nominal position, and still 0.01 inch deflection from its undeflected position of FIG. 4, providing sufficient axial return bias for adjacent structure.

Spring fingers 78, 79 are arranged to be substantially diametrically opposite one another when clamp ring 15 is in the closed condition to exert a substantially balanced and uniform force upon coil assembly 14. It is apparent, however, that side to side structural deviations can be accommodated as well by this device and that more than two spring fingers could be utilized in other embodiments of the invention. It is apparent as well that clamp ring 15 could be used for applications other than the solenoid valve assembly 10 described wherein axial, loaded retention of various elements is desired. Thus, for example, clamp ring 15 could be used to secure bearings on shafts and wheels on axles or the like. Similarly, it is apparent that clamp ring 15 could be used for applications where non-circular members are involved, and in such instances, central opening 80 could be modified to conform to other configurations.

We claim:

1. A solenoid valve assembly, comprising a valve body, a core tube secured on said valve body and extending outwardly therefrom to a free end, said core tube having a shoulder at said free end, a pole piece and plunger disposed in said core tube, said pole piece being fixed therein and said plunger being slidable in response to a magnetic field for actuating a valve in said valve body, an electromagnetic coil assembly mounted on said core tube for establishing said magnetic field in response to an electrical current, and a contractible ring encircling said core tube at said free end between said shoulder and said coil assembly for retaining said coil assembly on said core tube and for biasing said coil assembly toward said valve body, said ring having means thereon for adjustably securing said ring in various contracted sizes, and bias means for urging said coil assembly toward said valve body.

2. The valve assembly set forth in claim 1 wherein said ring is circumferentially contractible and said securing means comprises latch means for releasably securing said ring in various circumferential sizes.

3. The valve assembly set forth in claim 2 wherein said latch means comprises a plurality of circumferentially spaced teeth for providing discrete circumferential sizes of said ring.

4. The valve assembly set forth in claim 3 wherein said ring is split and has two ends, one of said ends having a tongue with a plurality of said teeth thereon, said other end having a socket with a plurality of said teeth therein, said tongue adapted for slidable fit in said socket and for interengagement of said respective teeth thereon.

5. The valve assembly set forth in any one of claims 1–4 wherein said bias means is integral with said ring and said ring comprises a unitary molded plastic part.

6. The valve assembly set forth in any one of claims 1–4 wherein said bias means is integral with said ring and comprises two springs substantially evenly disposed about said solenoid tube.

7. The valve assembly set forth in any one of claims 1–4 wherein said bias means is integral with said ring and comprises a pair of spring fingers disposed on opposite sides of said solenoid tube.

8. A solenoid valve assembly, comprising a valve body, a core tube assembly affixed to said valve body, said core tube assembly having one member thereof projecting outwardly of said valve body and terminating in an outer end with an annular recess in said end, an electromagnetic coil assembly disposed on said core tube assembly for establishment of a magnetic field in response to an electrical current for actuating said core tube assembly and a valve in said valve body, said coil assembly having a central opening and being slidable over said one member of said core tube assembly, and a contractible ring encircling said one member and disposed in said groove for retaining said coil assembly, said ring being split and having two interengageable ends, latch means on said ends for securing said ends in an interengaged position, and bias means for urging said ring into engagement with said groove and for biasing said coil assembly toward said valve body.

9. The valve assembly set forth in claim 8 wherein said bias means is integral with said ring and comprises at least two springs distributed about said ring.

10. The valve assembly set forth in claim 9 wherein said springs comprise a pair of spring fingers disposed on opposite sides of said ring.

11. The valve assembly set forth in claim 10 wherein said ring is formed of molded plastic.

12. The valve assembly set forth in any one of claims 8–11 wherein said latch means comprises a plurality of interengageable teeth on said ends, said teeth being arranged to slide over one another when said ring is contracted and to intermesh and prevent expansion of said ring.

13. The valve assembly set forth in any one of claims 8–11 wherein said latch means comprises a tongue and socket interconnection at said ends of said ring, a plurality of interengageable teeth on said tongue and said socket, said teeth being sloped in opposite directions to allow said teeth to slide over one another as said tongue is inserted in said socket to contract said ring, said teeth intermeshing and interlocking to prevent removal of said tongue from said socket, and means for disengaging said teeth to allow said tongue to be removed from said socket.

14. The valve assembly set forth in claim 13 wherein said disengaging means comprises an access slot in said one end of said ring to allow insertion of a tool for distortion of said socket to cause disconnection of said teeth.

15. A clamp ring for securing axially slidable structure relative to a support member which has a shoulder thereon to prevent axial movement of the clamp ring, comprising a unitary molded body member having a pair of clamp arms with a thinner flexible section therebetween, said clamp arms being pivotal relative to one another in a plane to encompass said support member, said clamp arms having confronting openings conforming to said support member so as to encircle said support member, and free ends thereon adapted for positioning adjacent one another, a socket in one of said free ends, a tongue on said other free end adapted for sliding engagement in said socket as said clamp arms are pivoted toward one another, latch means on said tongue and socket adapted for interlocking interengagement to retain said tongue in said socket, and spring means on each of said clamp arms for biasing said body member in an axial direction relative to said shoulder on said support member.

16. The clamp ring set forth in claim 15 wherein said latch means comprise plural teeth on said tongue and socket for adjustable latching engagement of said clamp arms.

17. The clamp ring set forth in claim 16 wherein said spring means comprises an integrally molded spring finger on each of said clamp arms, said body member having substantially parallel upper and lower surfaces, said spring fingers having tips thereon which protrude axially from one of said surfaces and are adapted for flexure to a recessed position below said surface.

* * * * *